US009506318B1

(12) United States Patent
Brunet

(10) Patent No.: US 9,506,318 B1
(45) Date of Patent: Nov. 29, 2016

(54) CEMENTING WELL BORES

(71) Applicant: SOLID Completion Technology, LLC, Houston, TX (US)

(72) Inventor: Charles Gerard Brunet, Houston, TX (US)

(73) Assignee: Solid Completion Technology, LLC, Houston, TX (US)

( * ) Notice: Subject to any disclaimer, the term of this patent is extended or adjusted under 35 U.S.C. 154(b) by 93 days.

(21) Appl. No.: 14/451,003

(22) Filed: Aug. 4, 2014

Related U.S. Application Data

(60) Provisional application No. 61/998,243, filed on Jun. 23, 2014.

(51) Int. Cl.

| | |
|---|---|
| ***E21B 33/13*** | (2006.01) |
| ***E21B 33/16*** | (2006.01) |
| ***E21B 41/00*** | (2006.01) |
| *E21B 47/00* | (2012.01) |

(52) U.S. Cl.
CPC ..... *E21B 33/16* (2013.01); *E21B 41/00* (2013.01); *E21B 47/0005* (2013.01)

(58) Field of Classification Search
CPC ..... E21B 28/00; E21B 33/13; E21B 33/14; E21B 33/16; E21B 47/0005
See application file for complete search history.

(56) References Cited

U.S. PATENT DOCUMENTS

| | | | | |
|---|---|---|---|---|
| 3,335,801 | A * | 8/1967 | Wilsey | E21B 28/00 166/177.4 |
| 3,557,875 | A * | 1/1971 | Solum | E21B 28/00 166/177.4 |
| 4,074,756 | A | 2/1978 | Cooke, Jr. | |
| 4,384,625 | A * | 5/1983 | Roper | E21B 7/24 166/301 |
| 4,407,365 | A | 10/1983 | Cooke, Jr. | |
| 4,705,117 | A * | 11/1987 | Warren | E21B 4/00 175/107 |
| 5,152,342 | A * | 10/1992 | Rankin | E21B 33/14 166/177.4 |
| 6,009,948 | A | 1/2000 | Flanders et al. | |
| 6,053,245 | A | 4/2000 | Haberman | |
| 6,725,923 | B1 | 4/2004 | Ivannikov et al. | |
| 6,779,598 | B2 | 8/2004 | Hall | |
| 7,275,600 | B2 | 10/2007 | Burge | |
| 7,841,410 | B2 | 11/2010 | Barbee | |
| 8,517,108 | B2 | 8/2013 | Schultz et al. | |
| 8,726,993 | B2 | 5/2014 | Cooke, Jr. | |
| 2007/0187112 | A1 * | 8/2007 | Eddison | E21B 31/113 166/380 |

(Continued)

FOREIGN PATENT DOCUMENTS

| | | | |
|---|---|---|---|
| GB | 2343465 | A | 5/2000 |
| WO | 2013151940 | A1 | 10/2013 |

OTHER PUBLICATIONS

C.E. Cooke Jr., Field Measurements of Annular Pressure and Temperature During Primary Cementing, Journal of Petroleum Technology, 10 pages, Aug. 1983, New Orleans, U.S.A.

(Continued)

*Primary Examiner* — Robert E Fuller
*Assistant Examiner* — Christopher Sebesta
(74) *Attorney, Agent, or Firm* — McGarry Bair PC

(57) ABSTRACT

A method and system of cementing a well bore with vibration of a casing string as a fluid cement mixture is forced into the annulus between the casing string and the well bore as a curable fluid cement mixture is pumped through the casing string. A casing shoe and/or a casing collar have a vibration-inducing mechanism for vibrating the shoe casing radially in response to the flow of fluid through the casing.

16 Claims, 9 Drawing Sheets

(56) References Cited

U.S. PATENT DOCUMENTS

| | | | | |
|---|---|---|---|---|
| 2008/0251254 | A1 | 10/2008 | Lynde et al. | |
| 2010/0212900 | A1 | 8/2010 | Eddison et al. | |
| 2010/0212901 | A1* | 8/2010 | Buytaert | E21B 7/24 166/286 |
| 2011/0232923 | A1 | 9/2011 | Barbee et al. | |
| 2011/0290485 | A1* | 12/2011 | Cooke, Jr. | E21B 23/02 166/286 |
| 2012/0118567 | A1 | 5/2012 | Cooke, Jr. | |
| 2014/0069639 | A1 | 3/2014 | Mackenzie et al. | |

OTHER PUBLICATIONS

C.E. Cooke Jr., Primary Cementing Improvement by Casing Vibration During Cement Curing Time, SPE Production Engineering, 10 pages, Aug. 1988, Copyright 1988 Society of Petroleum Engineers.

* cited by examiner

CEMENTING WELL BORES

CROSS REFERENCE TO RELATED APPLICATIONS

This application claims priority to U.S. Provisional patent application No. 61/998,243, filed Jun. 23, 2014, which is incorporated herein in its entirety.

BACKGROUND OF THE INVENTION

1. Field of the Invention

The invention relates generally to cementing of well bores.

2. Description of the Related Art

A casing string is generally a plurality of pipe segments, or joints, attached together which are run into a well bore and cemented in place. Casing strings are generally run into a well bore from a rig located on the surface. The casing string is normally not rotated or reciprocated during the run into the wellbore as this could cause damage to threaded connections between segments of the casing string. However, on some occasions the casing string may be rotated and reciprocated when run into the wellbore, particularly in the case of horizontal wells where the frictional forces between the casing string wall and the wellbore may be very high which may result in sticking of the casing string or the inability to run the casing string down to the designed depth. Casing string drag may be a serious problem, resulting in slow running in speed, premature sticking of the casing string, helical buckling or even casing string collapse.

Threaded collars are used to connect two segments of the casing string. A casing shoe is generally placed on the end of a casing string. A curable fluid cement mixture is pumped through the casing string, collars and casing shoe into an annulus formed between the casing string and the drilled wellbore. The casing shoe contains a check valve to prevent the backflow of the fluid cement mixture into the casing string.

The cementing of the casing can be a challenge, particularly in wellbores containing long horizontal sections. The casing string tends to lie along the bottom of the horizontal well bore, making it difficult to evenly disburse fluid cement mixture around the casing string. Often, centralizers are spaced along the casing string in an attempt to "centralize" the casing string in the well bore and to facilitate the placement of the fluid cement mixture evenly around the casing string. Specially designed centralizers have been designed to try and "swirl" the fluid cement mixture around the casing in a helical pattern to facilitate the placement of the fluid cement mixture.

SUMMARY OF THE INVENTION

In one embodiment, the invention relates to a method of cementing a well bore comprising the steps of: lowering a casing string into the well bore; pumping a curable fluid cement mixture through the casing string; forcing the fluid cement mixture into an annulus between the casing string and the well bore; and during the act of forcing the liquid cement mixture into the annulus, vibrating the casing string as the fluid cement mixture is forced into the annulus.

In another embodiment, the invention relates to a casing for use in cementing a well bore. The casing comprises a cylindrical housing having an open inlet end and an outlet end. The inlet end is configured to be attached an end of a casing string. The outlet end has an outlet port that is fluidly connected to the open inlet end of the cylindrical housing through a fluid flow path. A vibration-inducing mechanism is mounted within the cylindrical housing and is configured to vibrate the cylindrical housing radially of a longitudinal axis of the cylindrical housing in response to a flow of fluid through the fluid flow path.

In another embodiment, the invention relates a system for cementing a well bore in which a casing string extends from a surface of the earth and into an end portion of the well bore. The system further has a system for pumping a curable fluid cement mixture through the casing string to the end portion. A shoe casing at the end portion of the casing is provided for forcing the fluid cement mixture into an annulus between the casing string and the well bore. At least one vibration-inducing mechanism is mounted in the casing string for vibrating at least one portion of the casing string radially of a casing string axis in response to a flow of fluid through the shoe casing to, vibrate the casing string as the fluid cement mixture is forced into the annulus.

In one embodiment, the vibration-inducing mechanism can be mounted to the casing string with a frangible connection.

In another embodiment, the invention relates to a casing collar for use in cementing a well bore. The casing collar comprises a cylindrical housing having an open inlet end and an open outlet end. The open inlet end and open outlet end are configured to be attached to segments of a casing string to provide a fluid flow path between the open inlet end and open outlet end. A vibration inducing mechanism is mounted within the cylindrical housing in the fluid flow path such that the vibration-inducing mechanism vibrates the cylindrical housing radially in response to a flow of fluid through the flow path.

In one embodiment, vibration inducing mechanism can be mounted to the cylindrical housing with a frangible connection.

In another embodiment, the invention relates to a method of: lowering a casing string into a well bore comprising lowering a casing string into a well bore; pumping a fluid through the casing string as the casing is lowered into the well bore, and vibrating the casing string along at least one segment thereof as the fluid is pumped through the casing string and the casing string is lowered into the well.

In one embodiment, the vibrating act is radially of the casing string.

DESCRIPTION OF THE PREFERRED EMBODIMENT

Figure 1:
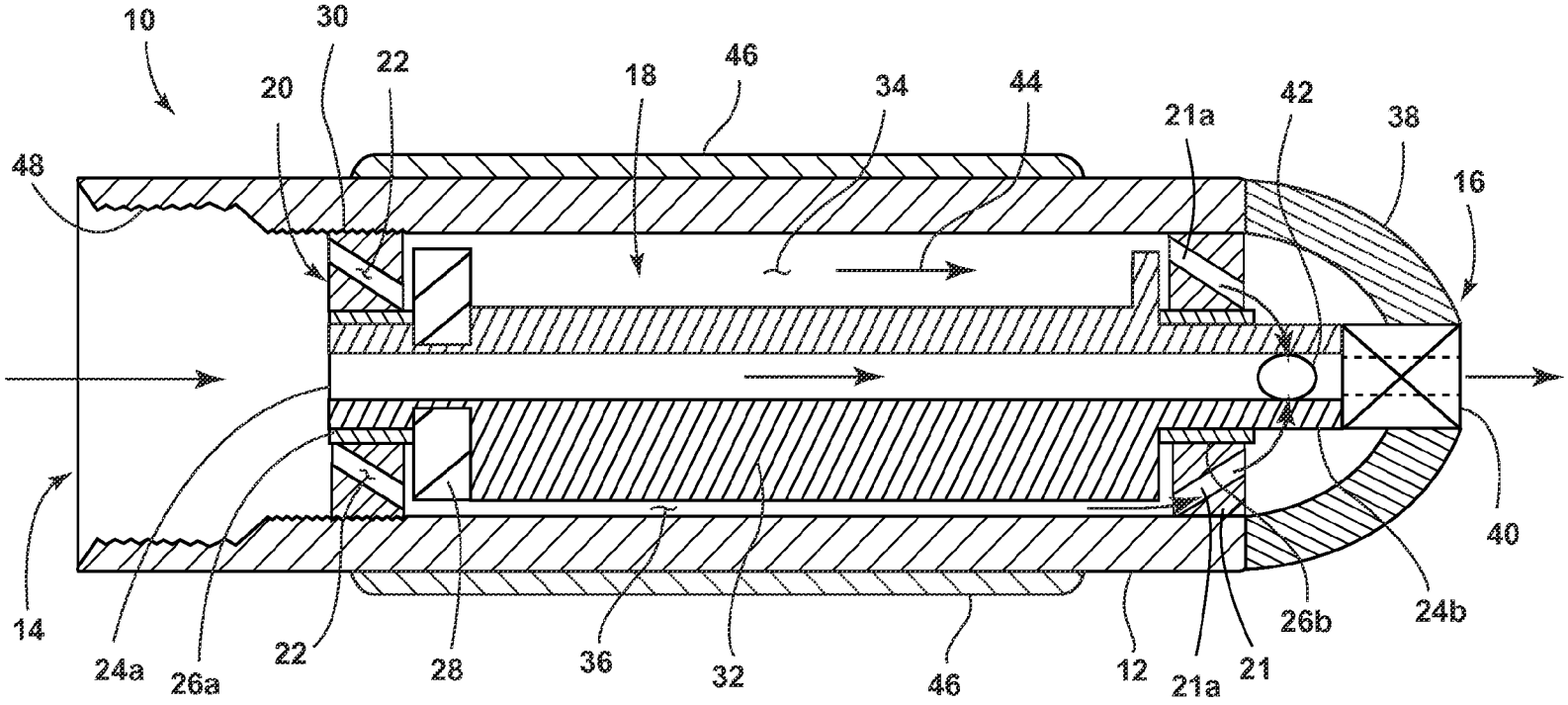
FIG. 1 is a section view of a casing shoe according to an embodiment of the invention.

Turning now to the drawings, and in particular to FIG. 1, there is shown a casing shoe 10 according to an embodiment of the invention. The casing shoe 10 comprises a cylindrical housing 12 defining an open inlet end 14 attached to a generally rounded hemispherical cone 38 defining an outlet end 16 encompassing a vibration-inducing mechanism 18. The inlet end 14 comprises a female threaded casing string connection 48 and the outlet end 16 comprises a check valve 40 extending through the cone 38.

The casing shoe 10 may also comprise a plurality of centralizers 46 formed from elongated strips of compliant material that are radially disposed around the outer circumference of the cylindrical housing 12 such that the centralizers 46 are spaced apart from one another around the outer circumference of the cylindrical housing 12. These centralizers maintain the casing shoe centered in the well bore.

The vibration-inducing mechanism 18 comprises a turbine rotor 28 and turbine body 32 mounted at its ends to hollow end shafts 24*a* and 24*b* between sleeves 26*a*, 26*b* such that the end shafts 24*a*, 24*b*, turbine rotor 28 and turbine body 32 rotate in unison about a longitudinal central axis. The turbine body 32 is asymmetric about the longitudinal central axis such that at any point of rotation about the longitudinal axis, a large gap 34 and a small gap 36 are formed between the turbine body 32 and the inner circumference of the cylindrical housing 12. A grease sleeve (not shown) can be attached to the turbine barrel as a reservoir for the grease used to lubricate the bearings during operation, if desirable.

The end shafts 24*a* and 24*b* are rotatably mounted on sealed grease sleeves or bearings 26*a*, 26*b*, respectively. The sleeve 26*a* at an inlet end 14 is disposed between the shaft 24*a* and an end plate 20 which is secured to the inner circumference of the cylindrical housing 12 by a corresponding threaded connection 30 between the end plate 20 and the cylindrical housing 12. The sleeve 26*b* is disposed between the end shaft 24*b* and an end plate 21 which is also secured to the inner circumference of the cylindrical housing 12. The end plate 21 has ports 21 a to pass fluid through the plate.

The end plate 20 can have a plurality of directional jet ports 22 configured to create a fluid path between the inlet end 14 and the turbine rotor 28 to drive rotation of the turbine rotor about the longitudinal axis. The end shaft 24*b* has a port 42 disposed in the outlet end 16 which is configured to fluidly communicate with the check valve 40. The inlet end 14, jet ports 22, large gap 34, small gap 36, port 42 and check valve 40 define a fluid flow path through the casing shoe 10. A fluid path through the casing shoe is also formed by the central openings in the hollow end shaft 26*a*, turbine rotor 28, turbine body 32, the end shaft 26*b* and the check valve 40.

The casing shoe 10 can be constructed from a variety of materials including but not limited to steel, brass, cast iron, composite, plastics, ultra-high-molecular-weight polyethylene (UHMW) or other ferrous or non-ferrous materials. The vibration-inducing mechanism 18 may be constructed from materials including but not limited to brass, bronze or other relatively soft metals or plastics which are easily drilled to remove after use.

In operation, fluids entering the inlet end 14 flows through the jet ports 22, through the turbine rotor 28, around the turbine body 32 through the large and small gaps 34, 36, into the port 42 in the central shaft 24 and out the check valve 40 as indicated by arrows 44. In addition, the fluid flows through the hollow end shaft 26*a*, turbine rotor 28, turbine body 32, the end shaft 26*b* and the check valve 40. The fluid flowing through the turbine rotor 28 drives rotation of the turbine rotor 28 and in turn, rotation of the central shaft 24 and turbine body 32 about the central axis. The asymmetrical configuration of the turbine body 32 creates an unbalanced rotation which induces a vibration that radially propagates through the casing shoe 10. The turbine rotor 28 can be configured to optimize the rotational speed and torsional output of the turbine body 32 by selecting the size of the jet ports 22.

Figure 2:
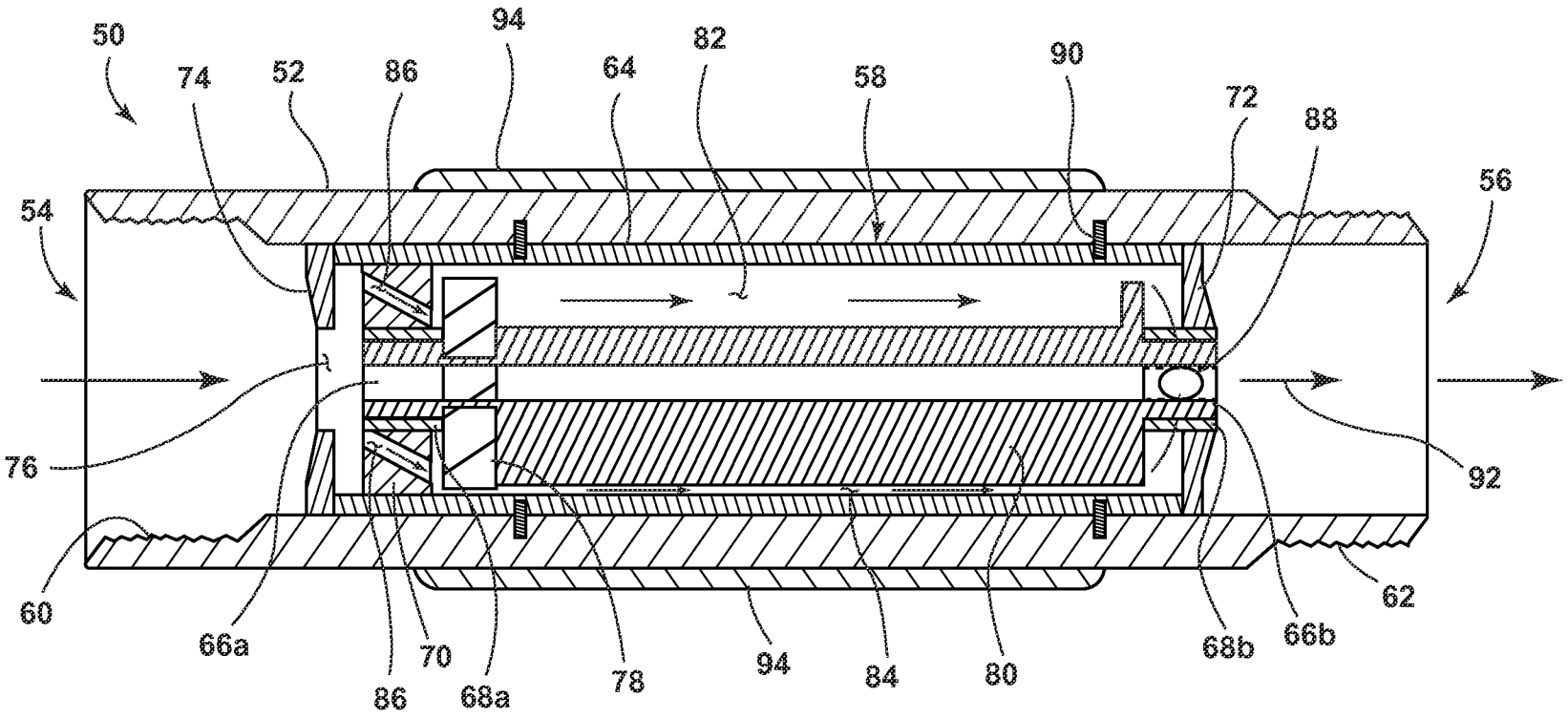
FIG. 2 is a section view of a casing collar according to an embodiment of the invention.

FIG. 2 shows a casing collar 50 according to an embodiment of the invention. The casing collar 50 comprises a cylindrical housing 52 having an open inlet end 54 and an open outlet end 56 surrounding a vibration-inducing mechanism 58. The open inlet end 54 comprises a female threaded casing string connection 60 and the open outlet end comprises male threaded casing string connection 62.

The casing collar 50 may also include a plurality of centralizers 94 formed from elongated strips of compliant material that are radially disposed around the outer circumference of the cylindrical housing 52 such that the centralizers 94 are spaced apart from one another around the outer circumference of the cylindrical housing 52

The vibration-inducing mechanism 58 comprises a cylindrical modular shear sleeve 64 mounted to the inner surface of the cylindrical housing 52 by frangible shear pins 90 between the open inlet end 54 and open outlet end 56, defining a longitudinal axis. A turbine rotor 78 and turbine body 80 are rotatably mounted to the cylindrical modular shear sleeve 64 through end shafts 66*a*, 66*b* and bearing sleeves 66*a*,66*b*, end plate 70 circular outlet support 72 so that the end shafts 66*a*, 66*b*, turbine rotor 78 and turbine body 80 rotate in unison. The turbine body 80 is asymmetric about the central longitudinal axis such that at any point of rotation about the longitudinal axis, a large gap 82 and a small gap 84 are formed between the turbine body 80 and the inner circumference of the cylindrical modular shear sleeve 64. A circular inlet support 74 having a central aperture 76 may also be secured to the cylindrical modular shear sleeve 64 near the inlet end 54.

The end plate 70 may have a plurality of jet ports 86 configured to create a fluid path between the open inlet end 54 and the turbine rotor 78 and the end shafts 66*a*, 66*b* may have a port 88 disposed in the area of the sleeve 68*b* which is configured to fluidly communicate with the outlet end 56. The open inlet end 54, jet ports 86, large gap 82, small gap 84, port 88 and open outlet end 56 define a fluid flow path through the casing collar 50. A fluid flow path is also defined through the hollow end shafts 66*a*, 66*b*. the turbine rotor 78 and the turbine body 80.

The casing collar 50 can be constructed from a variety of materials including but not limited to steel, brass, cast iron, composite, plastics, ultra-high-molecular-weight polyethylene (UHMW) or other ferrous or non-ferrous materials. The vibration-inducing mechanism 58 may be constructed from materials including but not limited to brass, bronze or other heavy materials which are frangible and can be easily drilled.

In operation, fluids entering the open inlet end 54 flows through the jet ports 86, through the turbine rotor 78, around the turbine body 80 through the large and small gaps 82, 84, into the port 88 in the central shaft 66 and out the open outlet end 56 as indicated by arrows 92. The fluid flowing through the turbine rotor 78 causes rotation of the turbine rotor 78 and in turn, rotation of the central shaft 66 and turbine body 80. The asymmetrical configuration of the turbine body 80 causes an unbalanced rotation which induces a vibration that radially propagates through the casing collar 50. The jet ports 86 can be configured to optimize the rotational speed and torsional output of the turbine body 80.

Figure 3:
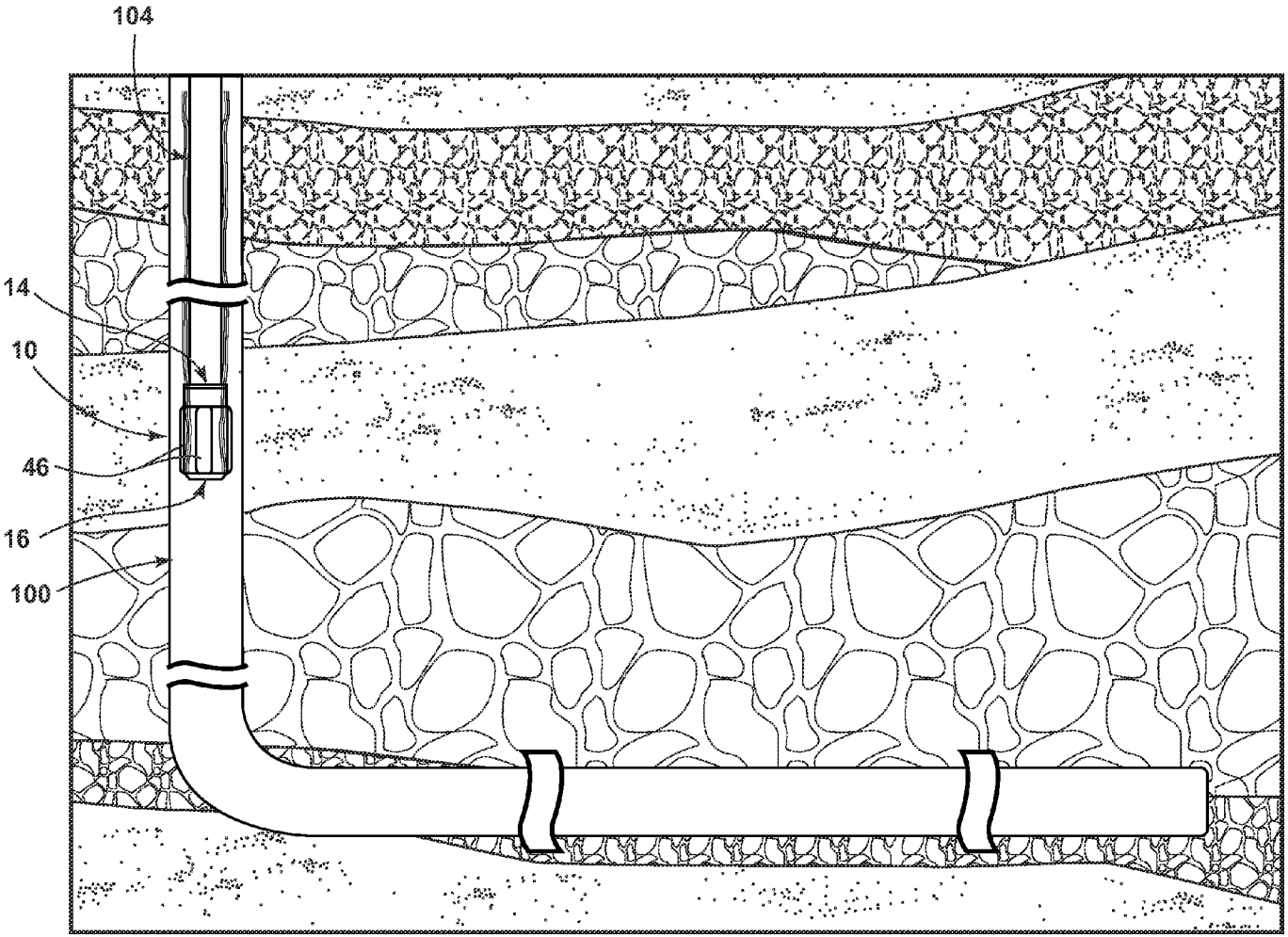
FIG. 3 is an elevation view of a well bore with a casing string being inserted therein according to an embodiment of the invention.

FIG. 3 shows an elevation view of a well bore 100 with a casing string 104 being inserted therein according to an embodiment of the invention. The casing shoe 10 is attached to the end of the casing string 104 and the casing string 104 and casing shoe 10 are inserted into the well bore. The centralizers 46 assists in keeping the casing shoe 10 and casing sting 104 centralized within the well bore 100. To aid in insertion, fluid such as drilling mud, water, chemicals or a mixture thereof is pumped into the casing string 104 and through the casing shoe 10. As the fluid flows through the inlet end 14 and outlet end 16 of the casing shoe 10, the casing shoe 10 vibrates. The vibration propagates through the casing shoe 10 and casing string 104 to further assist in running the casing string 104 into the well bore 100. The vibrations assist in running the casing string 104 into the well bore 100 because the vibrations reduce the frictional drag between the casing string 104 and well bore 100.

Figure 4:
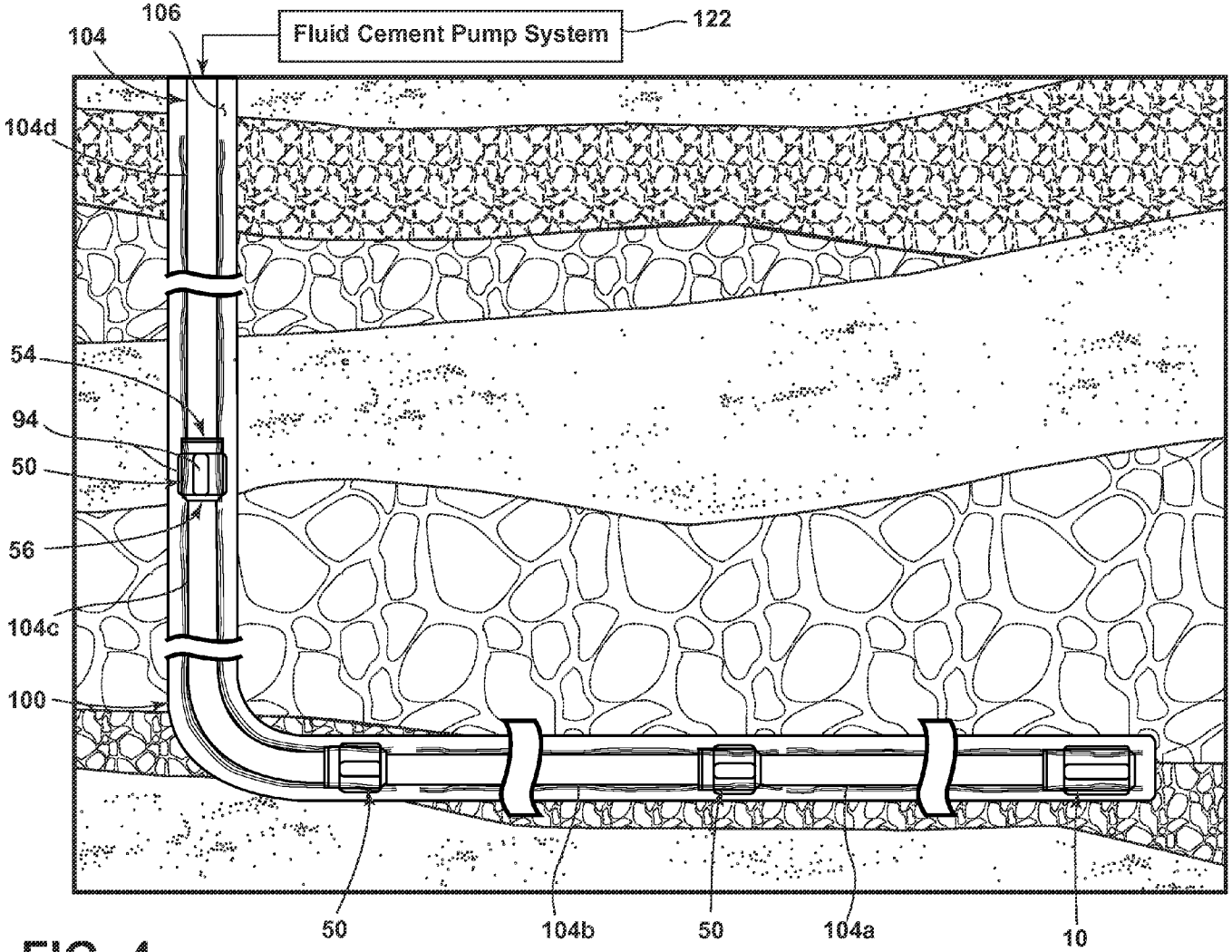
FIG. 4 is an elevation view showing the well bore of a FIG. 3 with the casing string at the bottom of the well bore according to an embodiment of the invention.

As the casing string 104 is run from the upper portion of the well bore 100 as shown in FIG. 3 to the end of the well bore 100 as shown in FIG. 4, one or more casing collars 50 are attached between casing string segments 104 a, b, c, d. The centralizers 94 assist in keeping the casing collars 50 and casing sting 104 centralized within the well bore 100 so that an annulus 106 is created between the casing string 104 and the well bore 100. To aid in insertion, fluid such as drilling mud, water, chemicals or a mixture thereof is pumped into the casing string 104 and through the casing collars 50. As the fluid flows through the open inlet end 54 and open outlet end 56 of the casing collars 50, the casing collars 50 vibrate. The vibrations propagate through the casing collars 50 and casing string 104 to further assist in running the casing string 104 into the well bore 100. The vibrations assist in running the casing string 104 into the well bore 100 because the vibrations reduce the frictional drag between the casing string 104 and well bore 100.

Figure 5:
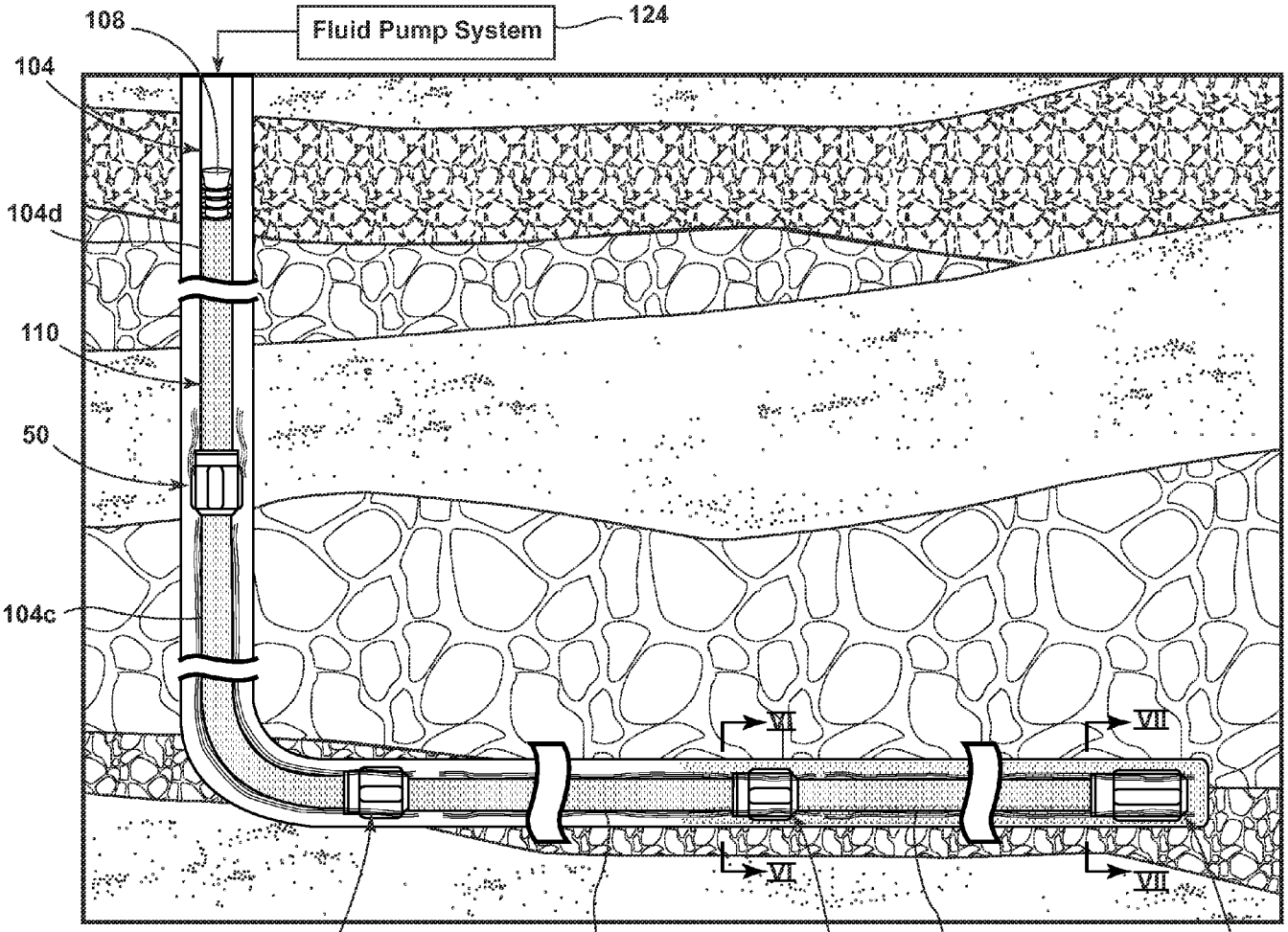
FIG. 5 is an elevation view showing the well bore and casing string of FIG. 4 with cement being forced through the casing string by a wiper plug according to an embodiment of the invention.

When the casing string 104 and casing shoe 10 has landed at the end of the well bore 100, a volume of a curable fluid cement mixture 110 is pumped into the casing string 104 from a conventional fluid cement pump system 122 as shown in FIG. 4. After the volume of curable cement mixture has been pumped into the casing, a cement wiper plug 108 is inserted into the casing string 104 behind the fluid cement mixture 110 as illustrated in FIG. 5. The area of the casing string 104 behind the cement wiper plug 108 is pressurized with fluid from a conventional fluid pump system 124 to force the cement wiper plug 108 down the casing string 104. The cement wiper plug 108 forces the fluid cement mixture 110 through the casing collars 50 and casing shoe 10 and into the annulus 106 between the well bore 100 and the casing string 104.

Figure 6:
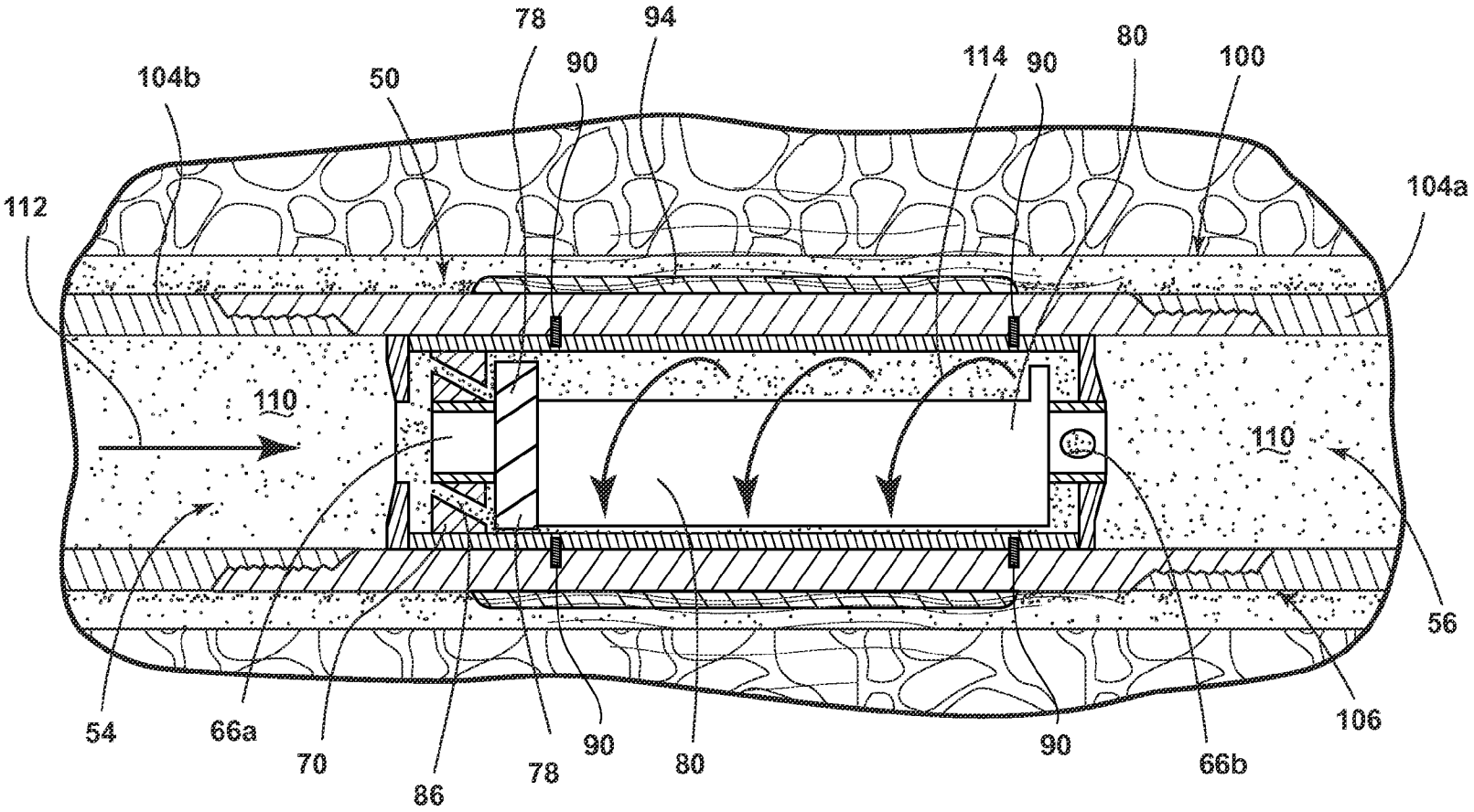
FIG. 6 is a sectional view of a casing collar along line VI-VI of FIG. 5 according to an embodiment of the invention.

FIG. 6 shows the fluid cement mixture 110 being forced through the casing collar 50. The fluid cement mixture 110 flows through the through the casing string segment **104*b*, through the open inlet end 54 and out of the open outlet end 56 of the casing collar 50 into the next casing string segment 104*a* as indicated by arrows 112. In the casing collar 50, the fluid cement mixture 110 flows through the jet ports 86 and through the turbine rotor 78, causing the turbine body 80 to rotate as indicated by arrows 114. The rotation of the turbine body 80 causes the casing collar 50 to vibrate and the vibration is imparted to the fluid cement mixture 110 in the annulus 106**.

Figure 7:
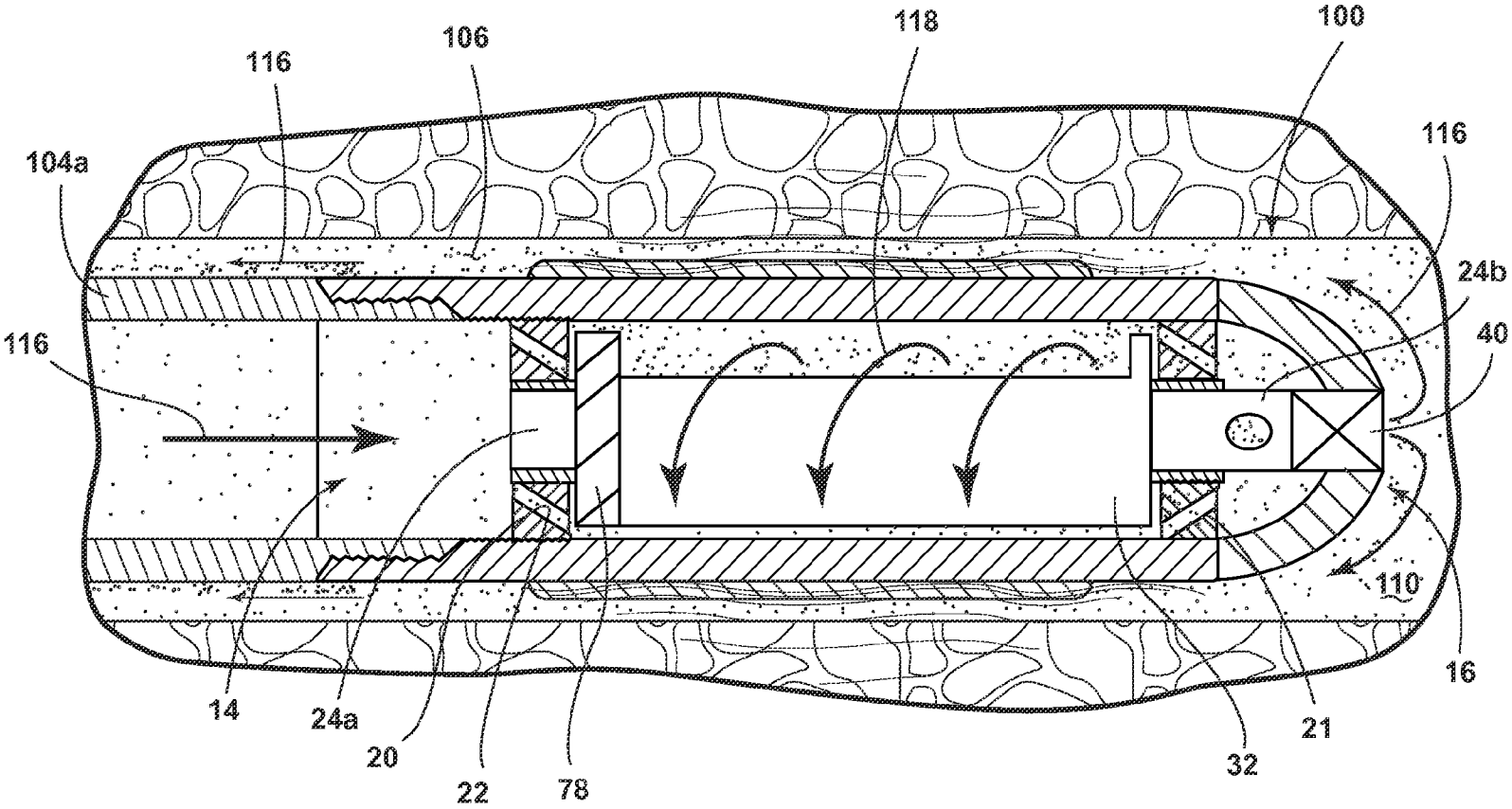
FIG. 7 is a sectional view of a casing shoe along line VII-VII of FIG. 5 according to an embodiment of the invention.

FIG. 7 shows the fluid cement mixture 110 being forced through the casing shoe 10. The fluid cement mixture 110 flows through the through the casing string segment **104*a*, through the inlet end 14, out the check valve 40 and is forced into the annulus 106 as indicated by arrows 116. In the casing shoe 10, the fluid cement mixture 110 flows through the jet ports 22 and through the turbine rotor 27, causing the turbine body 32 to rotate as indicated by arrows 118. The rotation of the turbine body 32 causes the casing shoe 10 to vibrate and the vibration is imparted to the fluid cement mixture 110 in the annulus 106**.

Figure 8:
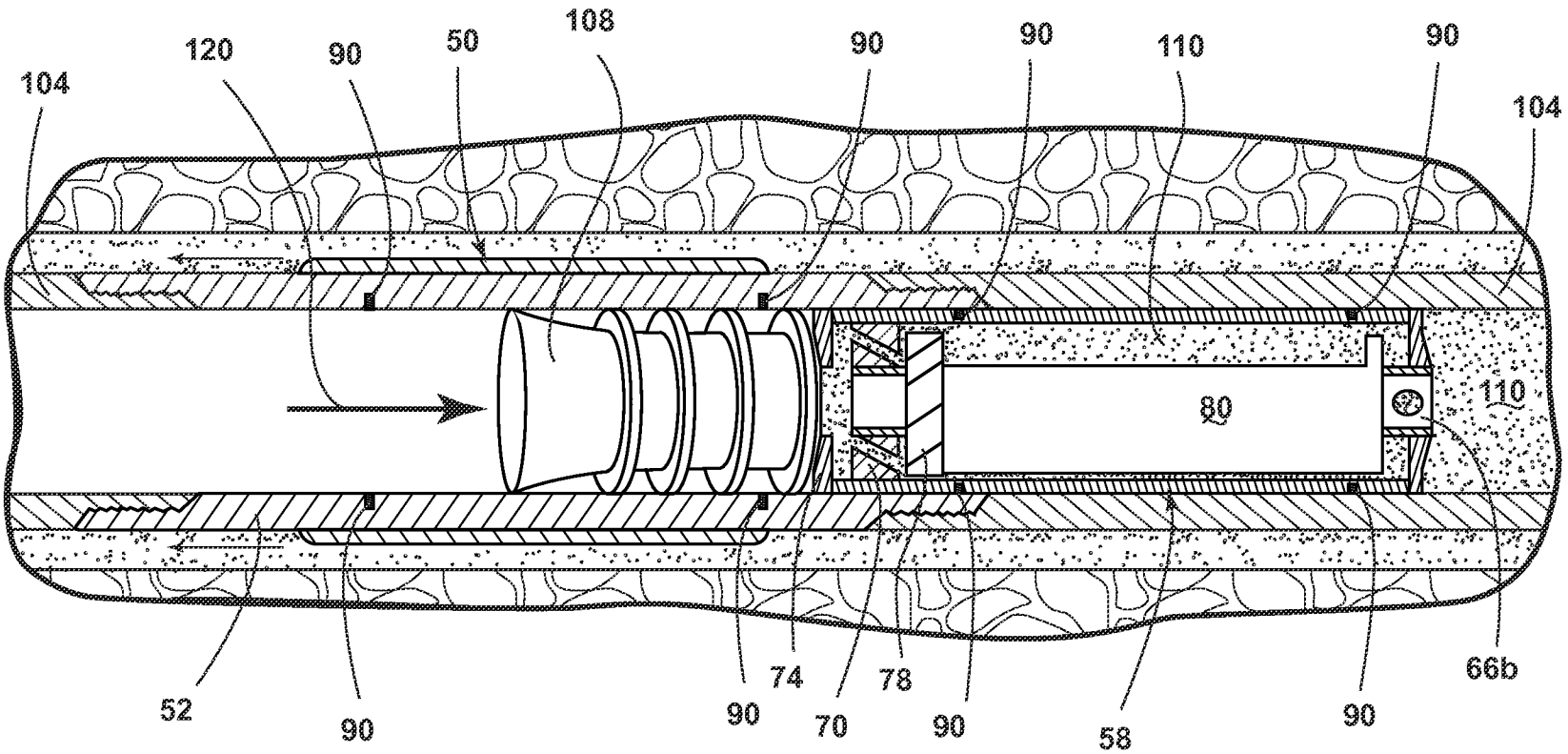
FIG. 8 is a sectional view of a casing collar attached to a casing string with cement being forced through the casing string and casing collar by a wiper plug according to an embodiment of the invention.

FIG. 8 shows the cement wiper plug 108 passing through the casing collar 50. As the cement wiper plug 108 is forced down the casing string 104 as indicated by arrow 120, it comes into contact with the circular inlet support 74 attached to the cylindrical modular shear sleeve 64. The cement wiper plug 108 exerts a force on the circular inlet support 74 and cylindrical modular shear sleeve 64 which causes the frangible shear pins 90 to shear, separating the vibration-inducing mechanism 58 from the cylindrical housing 52. When separated from the cylindrical housing 52, the vibration-inducing mechanism 58 is forced down the casing string 104 by the cement wiper plug 108.

Figure 9:
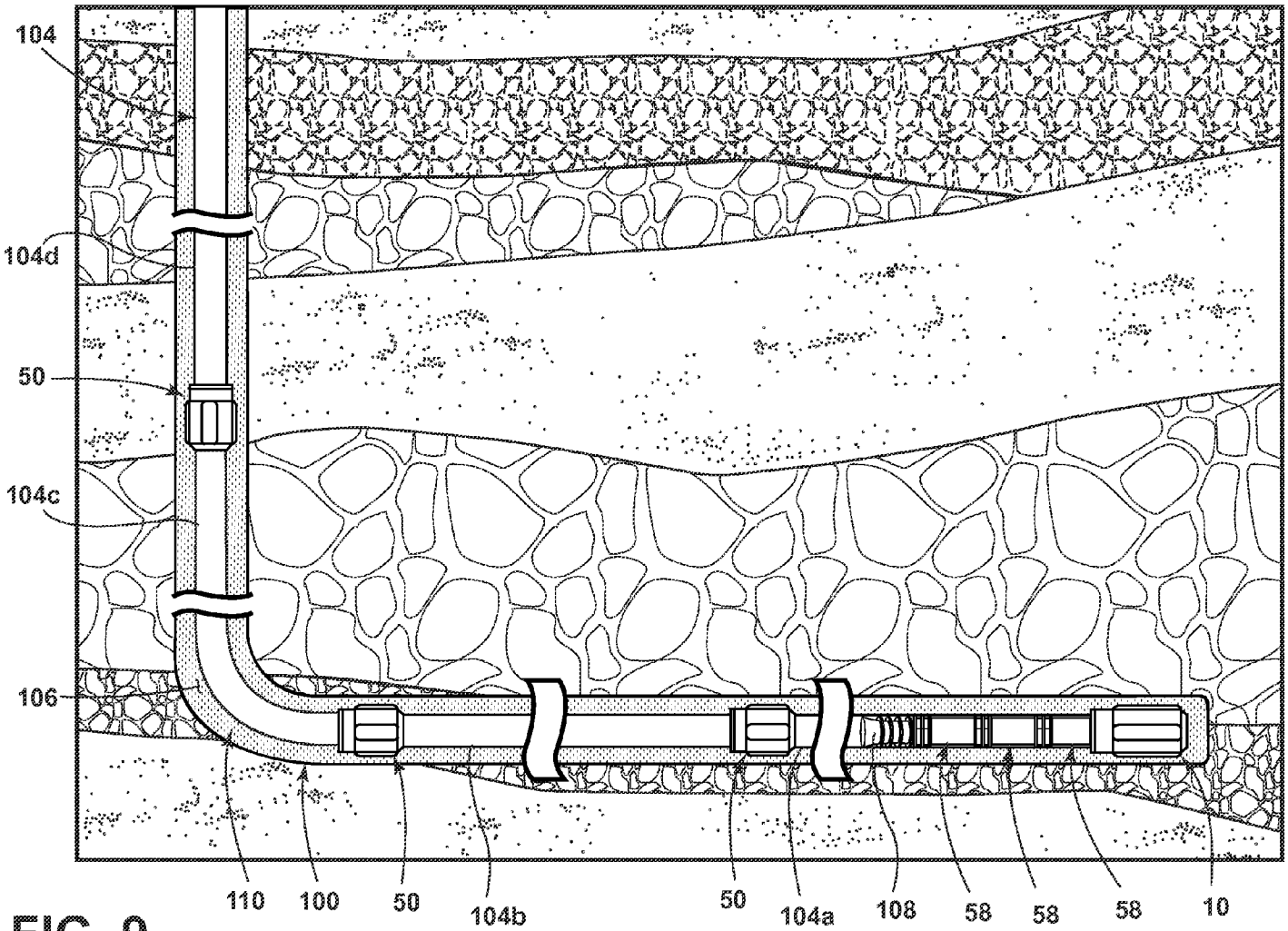
FIG. 9 is an elevation view of a well bore of FIG. 3 with the cement forced into the annulus between the casing string and well bore according to an embodiment of the invention.

FIG. 9 shows the cement wiper plug 108 at the end of the casing string 104. The cement wiper plug 108 forces the vibration-inducing mechanisms 58 of the casing collars 50 to the end of the casing string 104 until they contact the casing shoe 10 and also forces all of the fluid cement mixture 110 into the annulus 106. The casing collars 50 continue to vibrate until the vibration-inducing mechanisms 58 are forced out of the casing collars 50 and the casing shoe 10 continues to vibrate until all of the fluid cement mixture 110 is forced into the annulus 106.

The casing shoe 10 and casing collar 50 according to this invention and the method of cementing a well bore 100 using a casing string 104 equipped with a casing shoe 10 and casing collars 50 according to this invention provides for a number of benefits. The vibrations caused by pumping fluid through the casing collars 50 and casing shoe 10 as the casing string 104 is run into the well bore 100 reduces the frictional drag between the well bore 100 and casing string 104, which facilitates the extension of the casing string 104 further into the well bore 100 both vertically and laterally. Furthermore, the vibrations caused by pumping fluid cement mixture 110 through the casing collars 50 and casing shoe 10 as the fluid cement mixture is forced into the annulus 106 is likely to release entrained air in the fluid cement mixture 110 and to pack the fluid cement mixture 110 more densely, providing for a better bond between the casing string 104 and well bore 104. In addition, the vibrations caused by pumping the fluid cement mixture the casing collars 50 and casing shoe 10 may also assists in maintaining the cement tightly packed between the well bore and the casing as the fluid cement mixture solidifies. The integrated casing shoe centralizers 46 and casing collar centralizers 94 help to center the casing string 104 in the well bore 100 so that a uniform annulus 106 is created. Furthermore, the softer materials use in the construction vibration-inducing mechanisms 32, 58 of the casing shoe 10 and casing collars 50 can be drilled out to provide access to the end of the well bore 100 through the casing string 104.

The invention described above provides an apparatus and method to cement a casing in a wellbore with a good and contiguous bond along the length of the casing. Further, this invention provides an apparatus and method to for a good cement bond along the casing in a horizontal well without having to reciprocate and rotate the casing. Furthermore, the invention vibrates the cement to release the entrained air and to optimize the cement bond with both the casing and the wellbore. Still further, this invention more evenly and more completely disburses the cement along the casing. In addition, the invention maximizes the length that a casing string can be extended laterally. It also minimizes the issues associated with installing a casing in a horizontal wellbore. Still further the invention reduces the time required to install a casing in an oil and gas well. It further reduces the time required to install a casing in a horizontal oil and gas well. It also spaces the cement concentrically around the casing in the wellbore.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of cementing a well bore comprising the steps of:

lowering a casing string into the well bore;

pumping a curable fluid cement mixture through the casing string;

forcing the fluid cement mixture through the casing string into an annulus between the casing string and the well bore; wherein during the act of forcing the liquid cement mixture into the annulus, movement of the liquid cement mixture through the casing string causes at least one vibrating mechanism to vibrate the casing string as the fluid cement mixture is forced into the annulus, and after the forcing the fluid cement mixture ceases, forcing a wiper through the casing string to move the at least one vibrating mechanism to an end thereof.

2. The method of claim 1 wherein the act of vibrating the casing string includes vibrating at least an end portion of the casing string.

3. The method of claim 2 and wherein the act of vibrating the casing string further includes vibrating the casing string along a portion of the length thereof spaced from the end portion of the casing.

4. The method of claim 1 and further comprising inserting a cement wiper plug into the casing string subsequent to the pumping cement act and forcing the cement wiper plug to the bottom portion of the well bore.

5. The method of claim 4 wherein the act of forcing the cement wiper plug to the bottom of the well bore comprises pumping fluid into the casing string behind the cement wiper plug.

6. The method of claim 1 wherein the act of vibrating the casing string further includes vibrating the casing string along at least portions of casing string that receive the fluid cement mixture in the annulus during the act of forcing the liquid cement mixture into the annulus.

7. The method of claim 1 and further comprising curing the fluid cement mixture in the annulus subsequent to the act of forcing the liquid cement mixture into the annulus; and vibrating the casing string along at least portions of casing string that receive the liquid cement mixture in the annulus during the act of curing the liquid cement mixture.

8. The method of claim 1 where the vibrating act is radially of the casing string.

9. A casing for use in cementing a well bore comprising;

a cylindrical housing having an open inlet end and an outlet end, the inlet end is configured to be attached an end of a casing string, the outlet end having an outlet port that is fluidly connected to the open inlet end of the cylindrical housing through a fluid flow path;

a vibration-inducing mechanism having a cylindrical modular shear sleeve removably mounted to an inner surface of the cylindrical housing in the fluid flow path for vibrating the housing radially of a longitudinal axis of the cylindrical housing in response to a flow of fluid through the fluid flow path, and for removal of the cylindrical housing after the flow of fluid ceases by forcing a wiper through the casing string to move the vibration-inducing mechanism to an end thereof.

10. The casing of claim 9, wherein the vibration-inducing mechanism comprises a turbine rotatably mounted in the cylindrical housing.

11. The casing of claim 10, wherein the turbine comprises:

a longitudinal axis;

a turbine rotor; and a turbine body operatively connected to the turbine rotor and having mass distributed unequally about the longitudinal axis of the turbine.

12. The casing of claim 11, wherein the turbine body is asymmetric.

13. The casing of claim 9 wherein the cylindrical modular shear sleeve is mounted to the cylindrical housing with a frangible connection.

14. A casing of claim 9 wherein the cylindrical housing has an open outlet end, the open outlet end is configured to be attached to segments of a casing string, and thereby providing a fluid flow path between the open inlet end and open outlet end.

15. A method of: lowering a casing string into a well bore comprising:

lowering a casing string into a well bore;

pumping a fluid through the casing string as the casing is lowered into the well bore, and causing a vibrating mechanism in at least one segment of the casing string to vibrate as the fluid is pumped through the casing string and the casing string is lowered into the well, and removing the vibrating mechanism from the at least one segment after pumping the fluid has ceased by forcing a wiper through the casing string to move the vibration-inducing mechanism to an end thereof.

16. The method of: lowering a casing string into a well bore according to claim 15 wherein the vibrating act is radially of the casing string.

* * * * *